US007611193B2

(12) United States Patent
Bue et al.

(10) Patent No.: US 7,611,193 B2
(45) Date of Patent: Nov. 3, 2009

(54) TABLE AND SEATING ARRANGEMENT

(75) Inventors: Richard C. Bue, Eden Prairie, MN (US); John M. Elliott, Edina, MN (US); Kendall A. Kragenbring, Becker, MN (US)

(73) Assignee: Sico Incorporated, Edina, MN (US)

( * ) Notice: Subject to any disclaimer, the term of this patent is extended or adjusted under 35 U.S.C. 154(b) by 0 days.

(21) Appl. No.: 11/709,343

(22) Filed: Feb. 21, 2007

(65) Prior Publication Data

US 2007/0241591 A1 Oct. 18, 2007

Related U.S. Application Data

(63) Continuation-in-part of application No. 11/417,480, filed on Apr. 18, 2006, now abandoned.

(51) Int. Cl.
*A47B 83/02* (2006.01)

(52) U.S. Cl. ..... 297/141; 297/158.4; 297/159.1

(58) Field of Classification Search ..... 297/140–142, 297/157.1, 158.4, 159.1
See application file for complete search history.

(56) References Cited

U.S. PATENT DOCUMENTS

| | | | | | |
|---|---|---|---|---|---|
| 822,182 | A | * | 5/1906 | Cassel | 297/141 |
| 1,015,230 | A | | 1/1912 | Jacob | |
| 1,026,140 | A | * | 5/1912 | Bauer et al. | 108/42 |
| 1,339,232 | A | | 5/1920 | St. John et al. | |
| 1,370,952 | A | | 3/1921 | Danielson | |
| 1,457,582 | A | * | 6/1923 | Lewandoski | 297/141 |
| 1,622,327 | A | | 3/1927 | Livingood | |
| 1,652,100 | A | * | 12/1927 | Eastburn | 297/141 |
| 1,823,484 | A | | 9/1931 | Blumenthal | |
| 1,860,291 | A | | 5/1932 | Majcher | |
| 1,924,945 | A | | 8/1933 | Klotz | |
| 2,030,195 | A | | 2/1936 | Breese | |
| 2,321,177 | A | * | 6/1943 | Blossom | 297/141 |
| 2,353,892 | A | * | 7/1944 | Higgins | 297/141 |
| D152,784 | S | * | 2/1949 | Higgins | D6/337 |
| 2,521,160 | A | * | 9/1950 | Green | 297/141 |
| 2,621,710 | A | * | 12/1952 | Miller | 297/141 |
| 2,702,585 | A | | 2/1955 | Wilson | |
| 2,717,631 | A | | 9/1955 | Howe | |
| 2,721,778 | A | | 10/1955 | Wilson | |
| 2,730,417 | A | | 1/1956 | Mitchell | |
| 2,739,860 | A | | 3/1956 | Wilson | |
| 2,766,812 | A | * | 10/1956 | Schrader | 297/141 |
| 2,771,937 | A | | 11/1956 | Wilson | |
| 2,782,075 | A | | 2/1957 | Fagan | |
| 2,805,707 | A | | 9/1957 | Schoeppner | |
| RE24,454 | E | | 4/1958 | Wilson | |
| 2,934,386 | A | | 4/1960 | Shore | |
| 2,969,245 | A | | 1/1961 | Wilson | |
| 3,028,197 | A | | 4/1962 | Wilson | |

(Continued)

*Primary Examiner*—Peter R. Brown
(74) *Attorney, Agent, or Firm*—Merchant & Gould PC

(57) ABSTRACT

A table and seating arrangement includes a tabletop defining a longitudinal direction and having an edge. A frame mounts to an underside of the tabletop and includes risers and laterally extending portions. Casters or wheels mount to the frame and provide for easy rolling transport of the table and seating arrangement. Seating assemblies having two stools mount to the framework on linkages that provide for moving the seats from a use position with the seats extended beyond the edge of the tabletops and engaging the ground to a storage position wherein the seats are raised and retracted to be inward from the edges of the tabletop.

31 Claims, 18 Drawing Sheets

U.S. PATENT DOCUMENTS

| | | | |
|---|---|---|---|
| 3,055,705 | A | 9/1962 | Wilson |
| D194,038 | S | 11/1962 | Preston |
| 3,075,809 | A | 1/1963 | Wilson |
| 3,099,480 | A | 7/1963 | Wilson |
| 3,099,481 | A | 7/1963 | Bue |
| 3,101,064 | A | 8/1963 | Kanzelberger et al. |
| 3,109,678 | A | 11/1963 | Wilson |
| 3,212,463 | A | 10/1965 | Anderson et al. |
| 3,245,363 | A | 4/1966 | Amthor, Jr. et al. |
| 3,266,840 | A | 8/1966 | D'Estrube |
| 3,337,262 | A | 8/1967 | Katzfey et al. |
| D211,886 | S | 8/1968 | Benjamin |
| 3,411,823 | A | 11/1968 | Bue |
| 3,477,760 | A | 11/1969 | Bue |
| 3,511,532 | A | 5/1970 | Tringali et al. |
| 3,536,356 | A | 10/1970 | Wilson |
| 3,580,632 | A | 5/1971 | Seymour |
| 3,715,143 | A | 2/1973 | Gerken et al. |
| 3,877,086 | A | 4/1975 | Bue et al. |
| 3,900,905 | A | 8/1975 | Johnson et al. |
| 3,999,245 | A | 12/1976 | Bue et al. |
| 4,052,100 | A | 10/1977 | Nikitits et al. |
| 4,070,057 | A | 1/1978 | Jones |
| 4,100,858 | A | 7/1978 | Bue et al. |
| D250,151 | S | 11/1978 | Pingel |
| 4,131,311 | A | 12/1978 | Nikitits |
| 4,133,271 | A | 1/1979 | Carlson |
| 4,136,622 | A | 1/1979 | Bue et al. |
| 4,223,945 | A | 9/1980 | Nikitits |
| D257,623 | S | 12/1980 | Bue et al. |
| 4,249,773 | A | 2/1981 | Giambalvo |
| 4,337,670 | A | 7/1982 | Carlson |
| 4,449,263 | A | 5/1984 | Wilson et al. |
| 4,592,105 | A | 6/1986 | McNamara |
| 4,596,196 | A | 6/1986 | Gunter et al. |
| 4,653,804 | A | 3/1987 | Yoo et al. |
| 4,700,987 | A | 10/1987 | Sraka et al. |
| 4,793,011 | A | 12/1988 | Eve |
| 4,826,244 | A | 5/1989 | Choi |
| 4,883,314 | A | 11/1989 | Sakong |
| 4,885,813 | A | 12/1989 | McNamara |
| 4,932,333 | A | 6/1990 | Jensen et al. |
| 5,029,938 | A | 7/1991 | Song |
| D327,178 | S | 6/1992 | Ryaa |
| D327,779 | S | 7/1992 | Jensen et al. |
| D330,127 | S | 10/1992 | Song |
| 5,446,932 | A | 9/1995 | Voorhis |
| D369,913 | S | 5/1996 | Noll |
| 5,522,097 | A | 6/1996 | Ciccotelli |
| 5,652,978 | A | 8/1997 | Wiig |
| 5,683,135 | A | 11/1997 | Williams |
| 5,794,540 | A | 8/1998 | Dombrowski et al. |
| 5,906,015 | A | 5/1999 | Hilger et al. |
| D413,734 | S | 9/1999 | Bue |
| 6,065,802 | A | 5/2000 | Bue |
| 6,212,710 | B1 | 4/2001 | Jones |
| 6,254,178 | B1 | 7/2001 | Bue |
| 6,386,628 | B2 | 5/2002 | Bue |
| 6,772,699 | B1 | 8/2004 | Elliott |
| 7,159,940 | B1 * | 1/2007 | Atkins ..... 297/242 |

* cited by examiner

TABLE AND SEATING ARRANGEMENT

This application is a Continuation-In-Part of U.S. Utility patent application 11,417,480, filed Apr. 19, 2006, currently pending.

BACKGROUND OF THE INVENTION

1. Field of the Invention

The present invention relates to a table with folding seat structures and more particularly to a table with stools or benches that move between a use position and a storage position with the stools positioned beneath the tabletop.

2. Description of the Prior Art

In large, multi-purpose rooms that are utilized at various times as dining rooms, meeting halls, dance areas, training rooms, class rooms and for other varied activities, it is often desirable that multi-purpose furniture be used. Such furniture includes tables, chairs, benches and/or stools or table and seat combinations. Such furniture provides added utility if it is of a folding type, so as to take up less space when stored. Folding tables and accompanying stools or benches are well known and provide seating and tables that require less space for storage than when in use. Such folding tables are generally rectangular or oval with benches or stools placed on both sides or spaced around the table. Examples of folding tables are shown in U.S. Pat. Nos. 2,771,937 to Wilson, 3,075,809 to Wilson, 3,099,480 to Wilson, and 6,254,178 to Bue, all assigned to Sico, Inc., the Assignee of the present invention. Although such tables are successful in providing folding furniture with seating, still further improvements are possible. For many teaching, dining or other applications, especially with children, it can be appreciated that it is advantageous to provide a table that can be operated easily and safely with one hand and/or by children.

In addition to easy, simple and safe operation, it is also desirable to provide a table that provides a small footprint with a low storage area required/seat ratio when configured for storage. Folding table and seating arrangements typically fold along a center line while accommodating stools, benches or other seating. Computer training is a common use for rolling tables requiring quick transition from storage to use and back with equipment remaining on the tables during storage. Therefore, it is not possible to use a folding tabletop. With wireless technology and a non-folding tabletop, it is possible to leave laptop computers on the table to create a mobile cordless multi-user computer system. With such configurations, it is also advantageous for the table and seat assemblies to have folding seating capabilities so that the arrangements take up less space when stored. Moreover, it can be appreciated that the storage is improved if the tables can be stored so that the edges are flush with one another, thereby minimizing storage space.

It can be seen then that a new and improved table and folding seating arrangement is needed. Such a table and seating arrangement should provide for reduced storage area requirements without a folding top so that articles may be stored on the table when the table is not in use. Moreover, such a table and seating apparatus should have retractable seating that is easily and safely actuatable by children and preferably actuatable by a single hand. The present invention addresses these as well as other problems associated with table and seating structures.

SUMMARY OF THE INVENTION

The present invention is directed to a table and seating arrangement and in particular to a table and seating arrangement having seating that moves between an extended use position and a storage position with the seating positioned below the tabletop. The table and seating arrangement includes a tabletop with a supporting frame mounted on rollers or casters. The frame and tabletop are rigid unfolding arrangement. Seating assemblies mount to the frame on pivots or linkages and are movable between a use position extending laterally outward from sides of the table and a storage position wherein the seats are positioned beneath the underside of the tabletop.

Each of the seating assemblies generally includes a pair of stools mounted to a supporting framework with two or three support legs. It is also envisioned that benches or other seating types may also be used. Each seating assembly also has a pivot or a linkage mounted to a laterally extending portion of the frame or a mounting bracket and to the seating. The stool moves from a lowered position wherein legs of the seating assembly frame engage the ground to a retracted position wherein the stools are positioned entirely below the tabletop. With such a configuration, the storage requirements are greatly reduced.

The tabletop may be rectangular, oval or any other common table shape. In one embodiment, the table includes four seating assemblies with two stools in each assembly. It can be appreciated that a bench may interchangeably replace the two stools of the seating assembly. Moreover, other sizes and/or different numbers of stools may be utilized. One or more of the seating assemblies may also be removed to allow access by Americans with Disabilities Act (ADA) seating or other unconnected seating. It can be appreciated that with the stools retracted inward from the edge of the tabletop with a rectangular tabletop, the tables may be stored with the tabletops in an edge-to-edge relationship flush with one another and the tabletops may be placed against walls and in corners. This reduces the storage space needed for the tables and provides added utility. Moreover, as the tables are not folded during storage, equipment may be left on the table even while stored.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring to the drawings wherein like reference numerals and letters indicate corresponding structure throughout the several views.

DETAILED DESCRIPTION OF THE PREFERRED EMBODIMENTS

Figure 1:
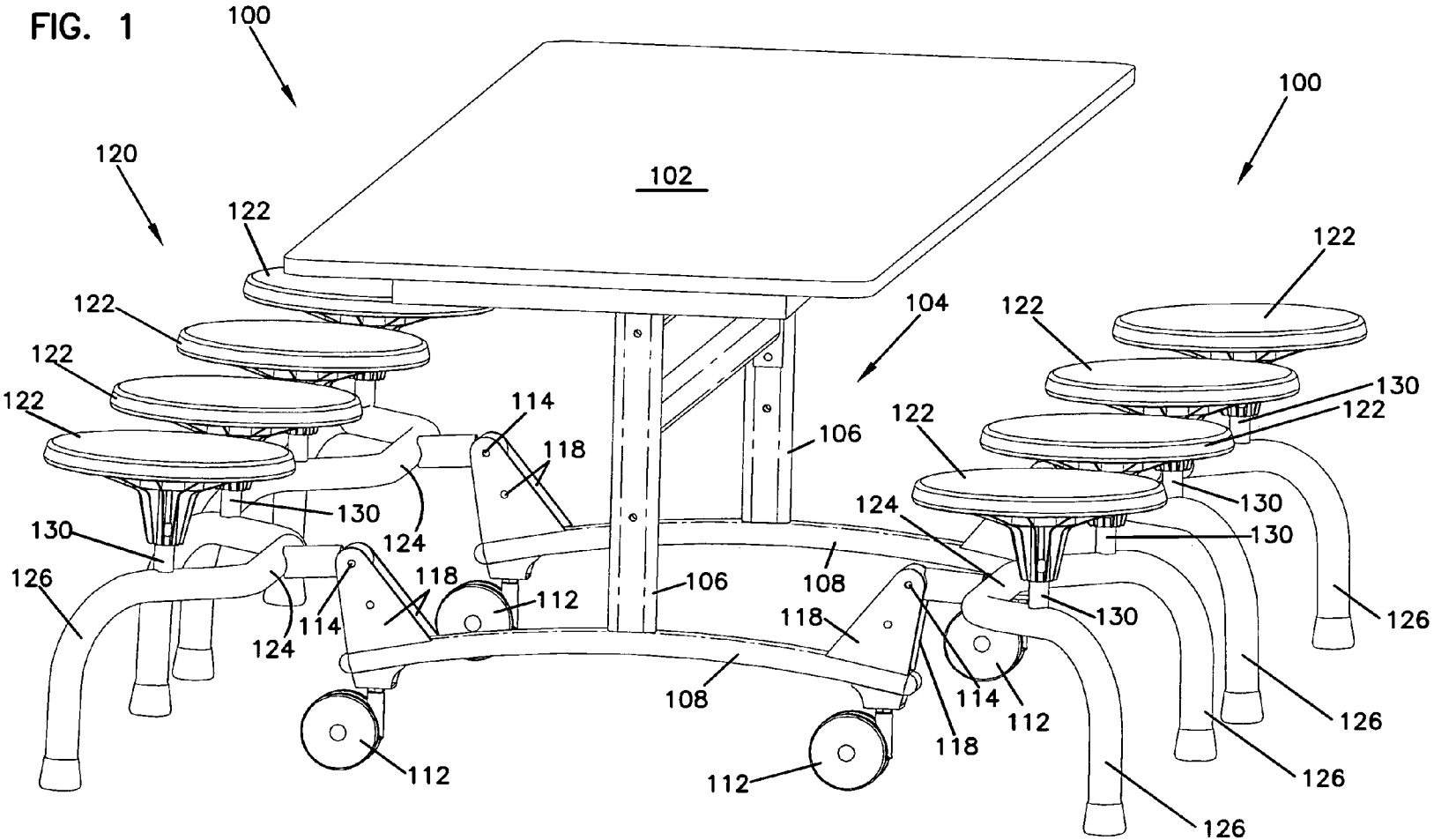
FIG. 1 is a perspective view of a first embodiment of a table and seating arrangement according to the principles of the present invention with seating assemblies in a use position.
Figure 2:
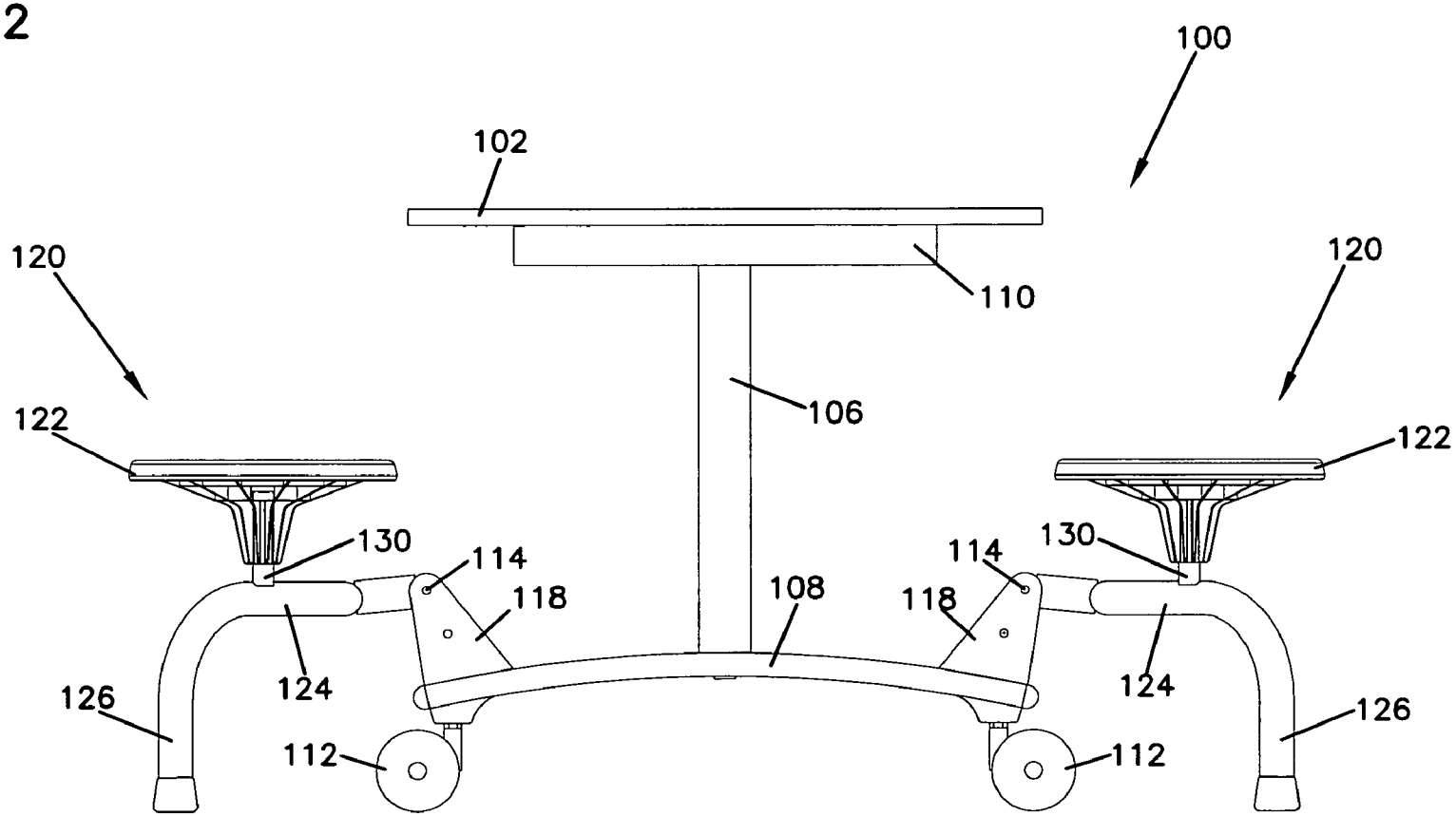
FIG. 2 is an end elevational view of the table and seating arrangement shown in FIG. 1.
Figure 3:
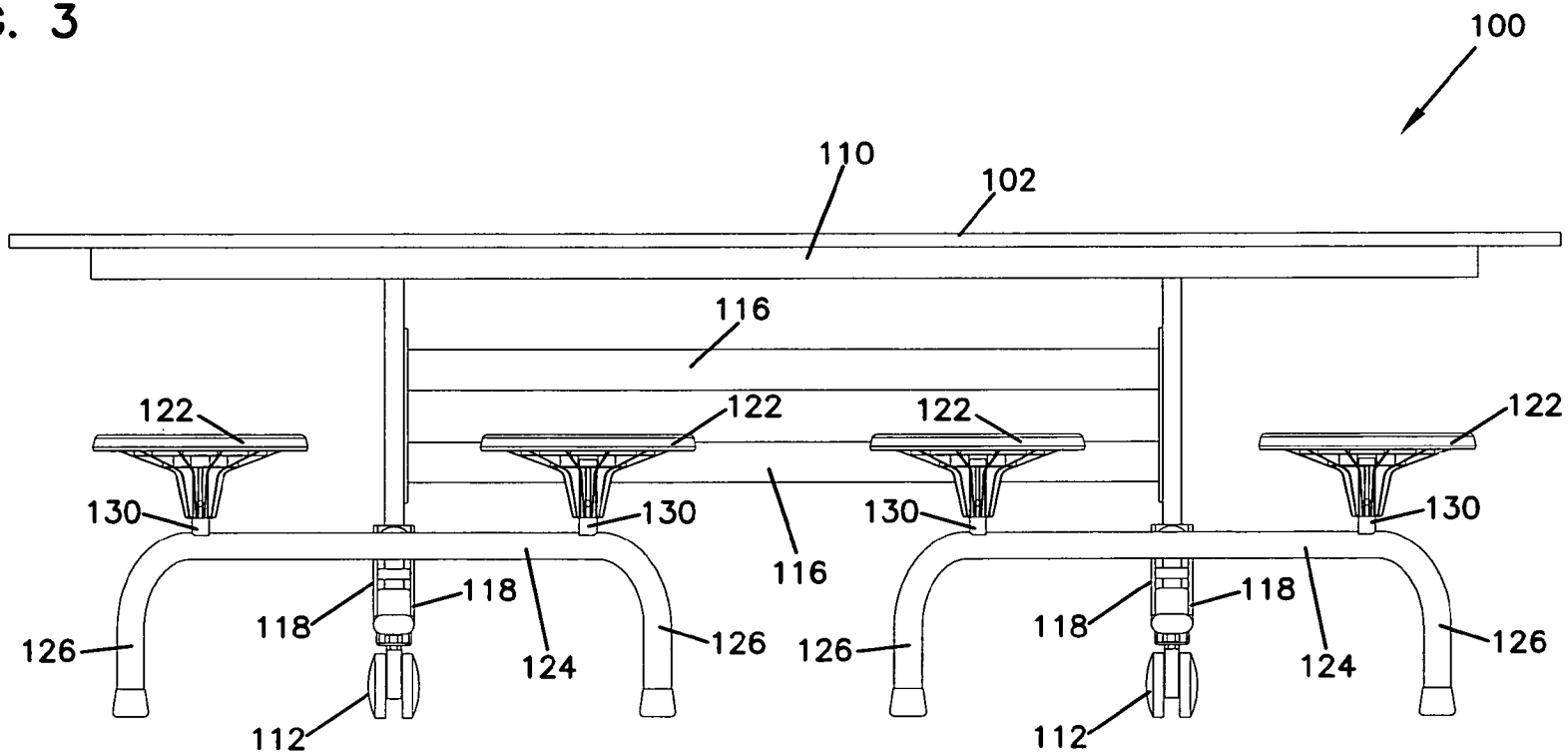
FIG. 3 is a side elevational view of the table and seating arrangement shown in FIG. 1.

Referring now to the drawings and in particular to FIG. 1, there is shown a first embodiment of a table and seating arrangement, generally designated 100. The table and seating arrangement 100 includes a stationary tabletop 102 supported by a rigid frame 104. The frame 104 includes several portions as discussed below and mounts on four casters or wheels 112 so that the table 100 may be rolled from location to location for use and storage. The frame 104 also supports four seating assemblies 120 mounted on pivots 114 that provide for shifting the seating assemblies 120 between a use position and a storage position, as explained hereinafter. Although four seating assemblies 120 are shown, it can be readily appreciated that other embodiments are possible with other types and/or numbers of seating assemblies 120. In addition, one or more of the seating assemblies 120 may be omitted, thereby providing ADA seating.

Figure 4:
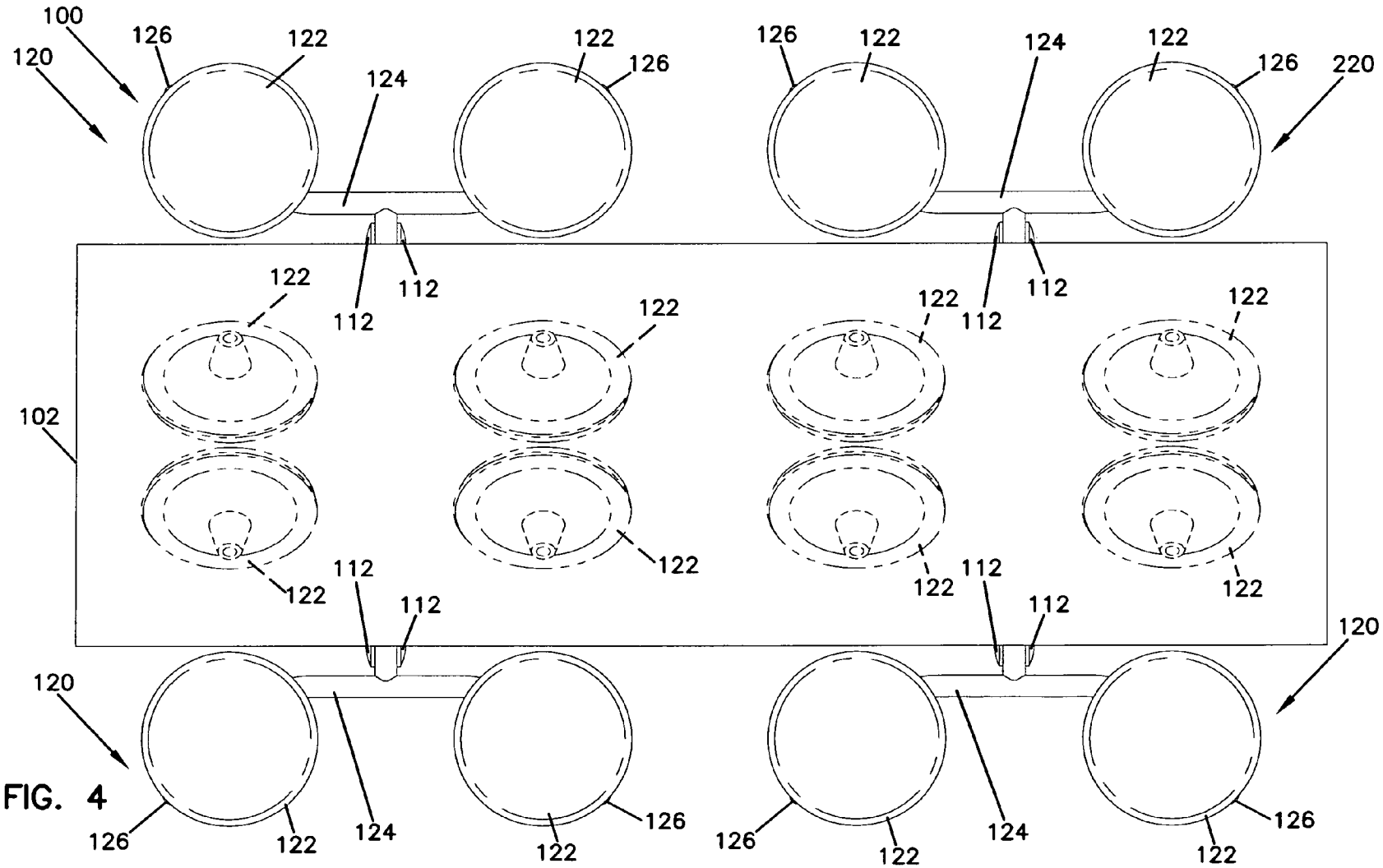
FIG. 4 is a top plan view of the table and seating arrangement shown in FIG. 1.

Referring now to FIGS. 1-7, the table and seating arrangement frame 104 has two riser portions 106 connected by longitudinal members 116 and extending upward from horizontal transverse members 108 extending laterally. A tabletop support portion 110 mounts to the underside of the tabletop and is supported by the upper ends of the riser portions 106. The support portion 110 provides a framework abutting the underside of the table top 102. The casters or wheels 112 mount at the ends of the transverse members 108 and preferably swivel so that transportation is easily accomplished in any direction. Each of the seating assemblies 120 pivotally mounts to the frame members 108 on bracket 118 formed of plates extending upward from the frame members 108 and forming the pivots 114 and includes stools 122 mounted on a seating assembly frame 124. In the first embodiment, each seating assembly 120 includes two stools 122 supported by the frame 124 and mounted so that each stool 122 may be accessed through an open passage without requiring a user to step over an obstruction, such as a portion of the framework. The seating assembly frame 124 includes a pair of legs 126 that engage the ground in the use position and provide a stable base for each seating assembly 120. The seating assembly frame 124 also includes seating support portions 130 extending to an underside of the center of each stool 122 and horizontal portions 128 that extend laterally along the table and outward from a center line of the table 100 to the legs 126. The legs 126 preferably engage the ground outward from the table and stools 122 so that a wide triangular support for each seating assembly 120 is achieved. As shown in the embodiment of FIGS. 1-7, the legs 126 are moved laterally and longitudinally outward at an approximately 45 degree angle as far as possible under the seating without limiting accessibility or causing a tripping hazard for table users. As shown in FIG. 4, the legs 126 are positioned at an outer edge of the associated seat 122, spaced laterally and longitudinally outward from the seating support 130 to create a broad base for each seating assembly 120. With this configuration of the legs 126, each seating assembly 120 is supported on a wide solid base formed by the legs 126 and the pivot 114, which are spaced far from one another in a stable triangular configuration.

Figure 5:
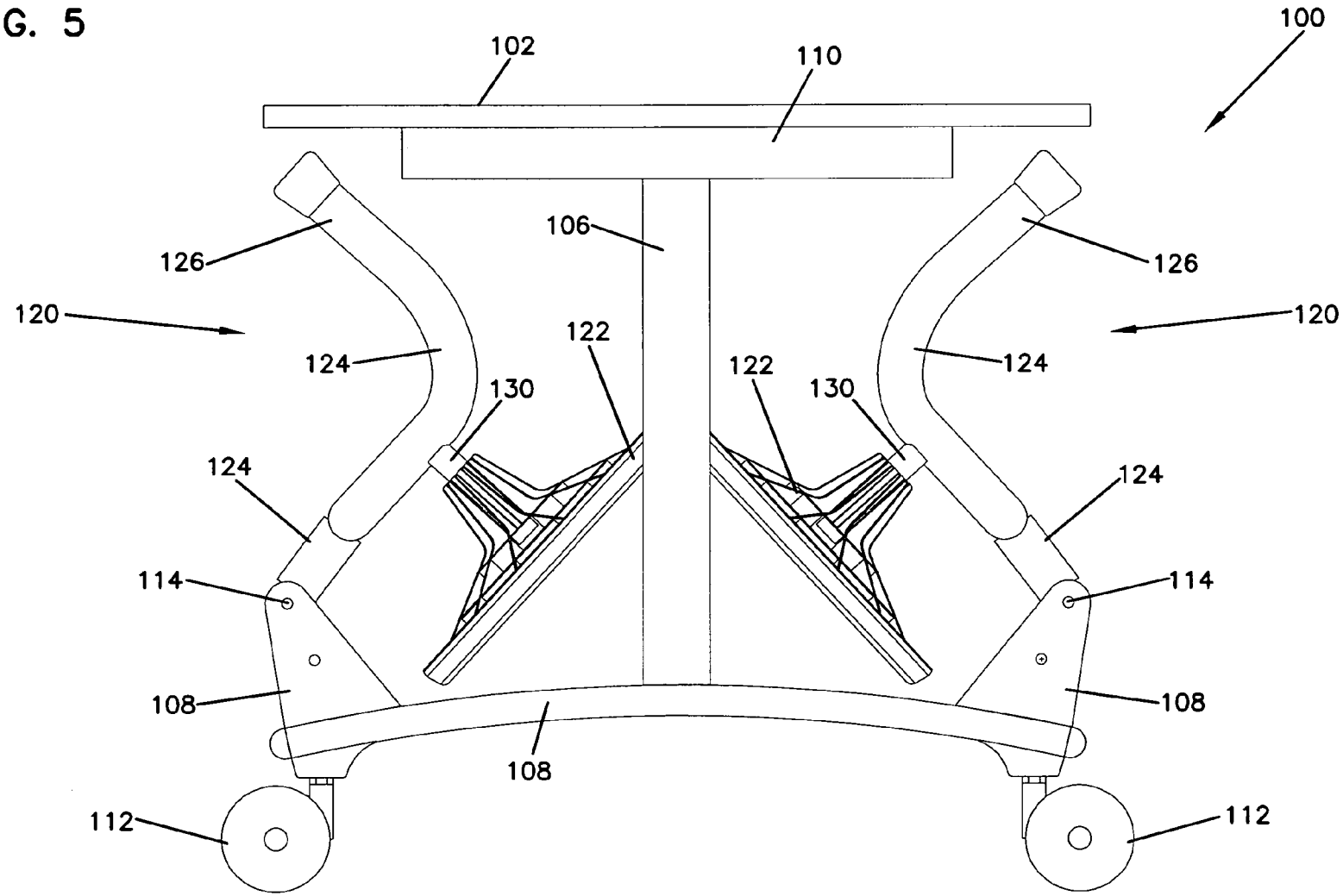
FIG. 5 is an end elevational view of the table and seating arrangement shown in FIG. 1 with the seating assemblies in a storage position.
Figure 6:
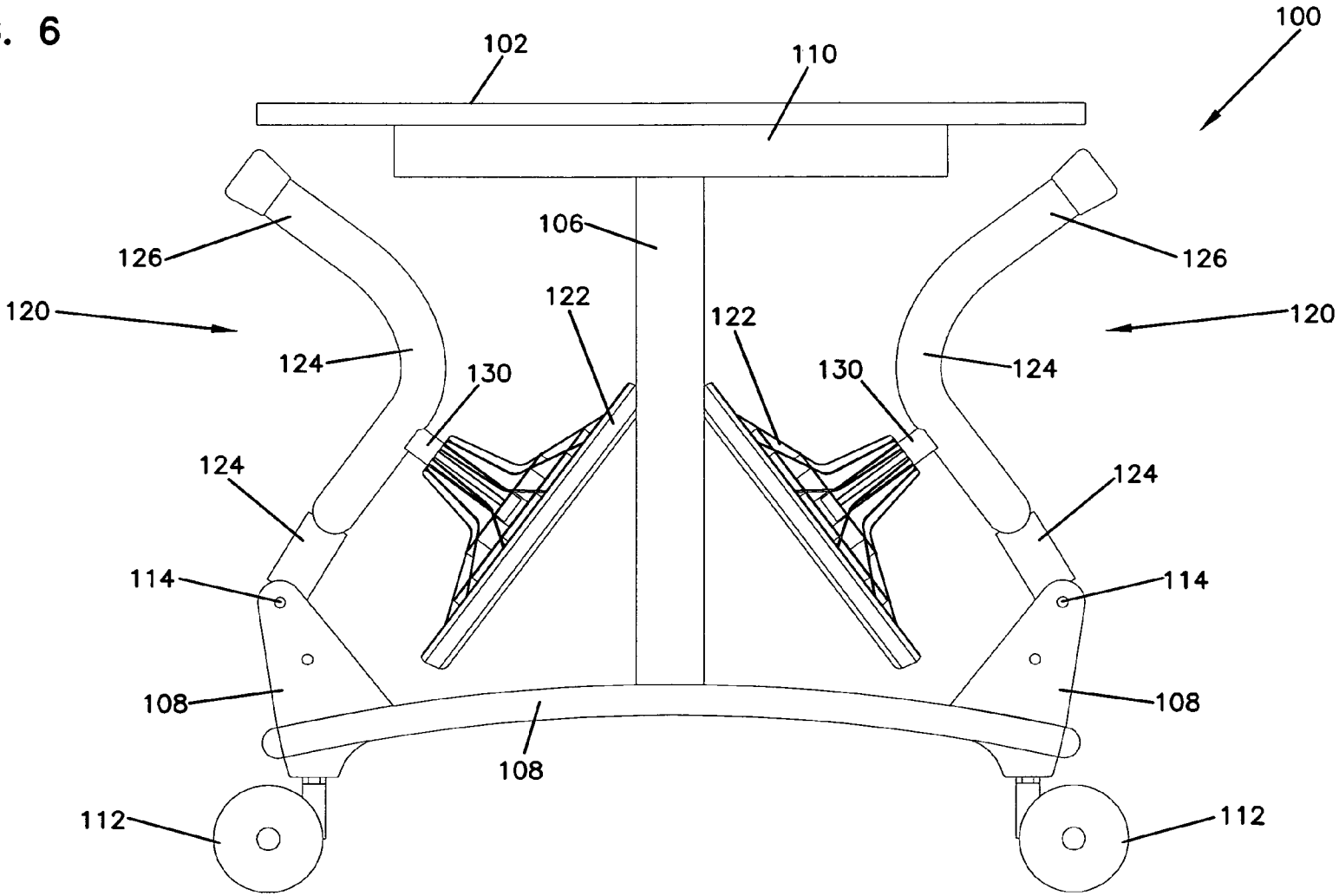
FIG. 6 is an end elevational view of the table and seating arrangement shown in FIG. 1 with the seating assemblies in a first intermediate position.
Figure 7:
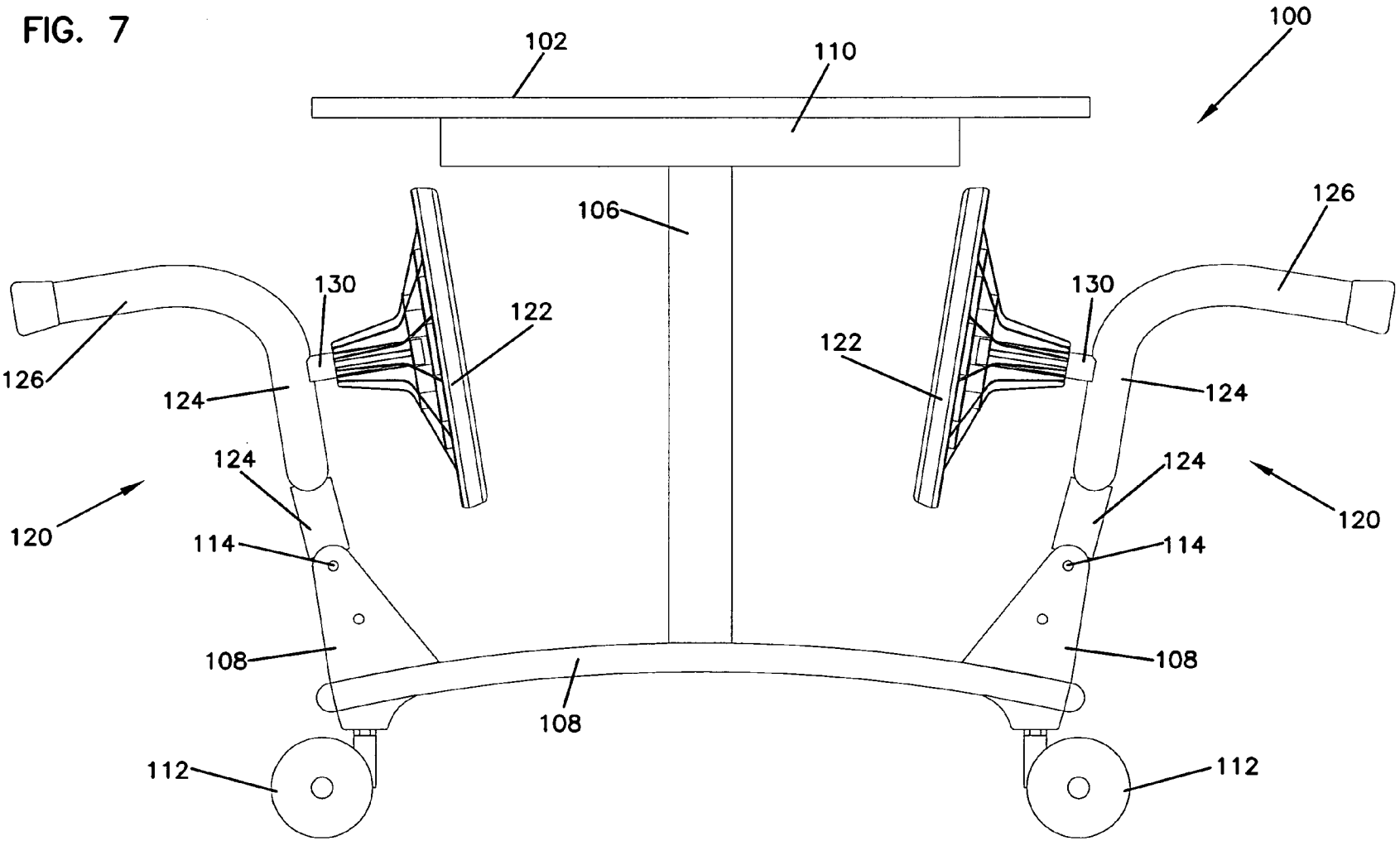
FIG. 7 is an end elevational view of the table and seating arrangement shown in FIG. 1 with the seating assemblies in a second intermediate position.

The pivot 114 allows for rotating the seating assemblies 120 from the use position shown in FIGS. 1-4 to the storage position shown in FIG. 5. It can be appreciated that the seating assemblies 120 pivot beyond an over center position so that they stay at the storage position shown in FIG. 5 without requiring a restraint or lock.

Figure 18:
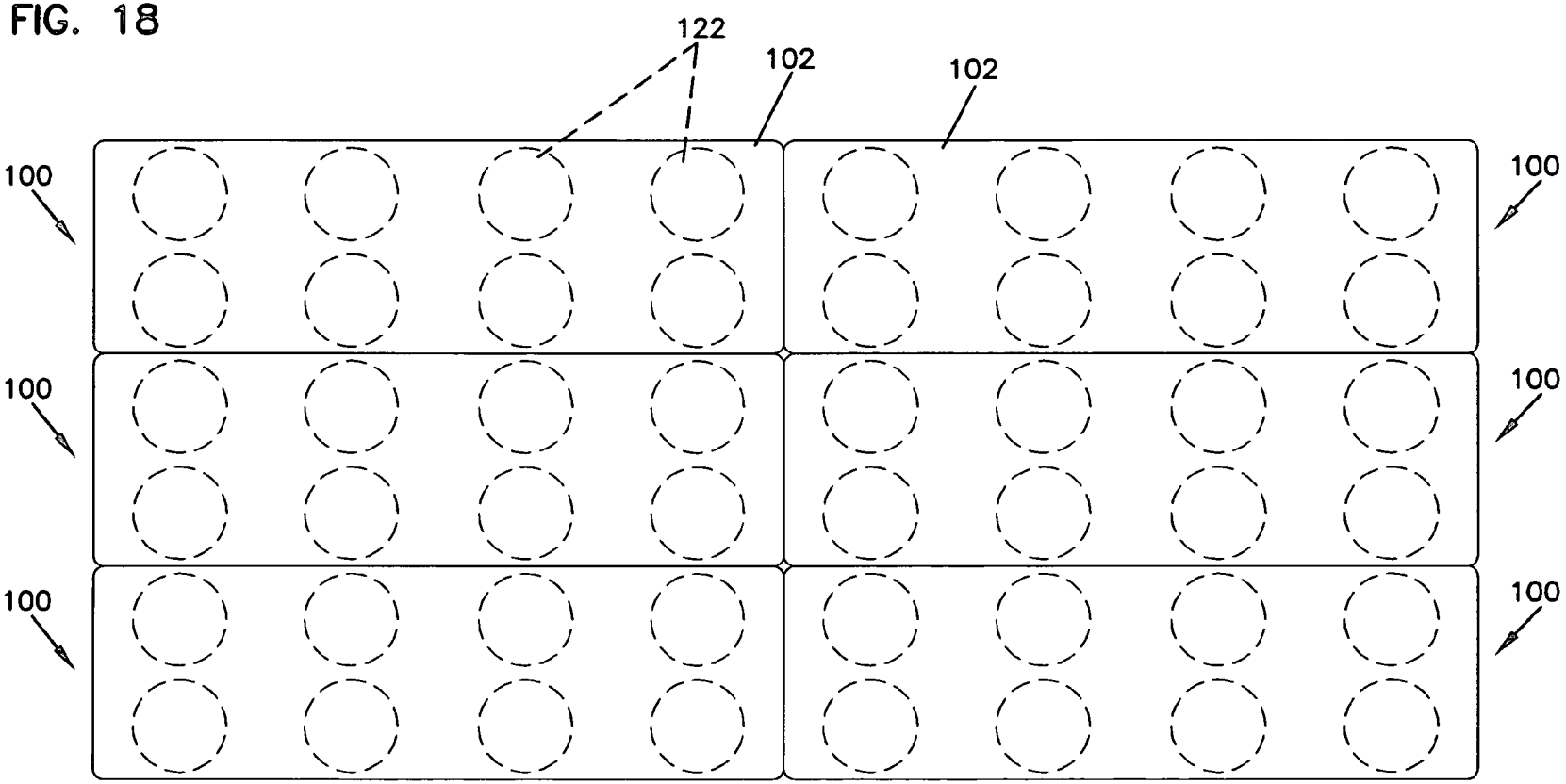
FIG. 18 is a top plan view of table and seating arrangements shown in FIG. 1 stored edge to edge.

As shown most clearly in FIG. 5 and as also shown in phantom in FIG. 4, when the seating assemblies 120 are moved to the storage position, the stools 122 and the entire seating assembly 120 are completely beneath the tabletop 102 and do not extend beyond the edges of the tabletop. It can be appreciated that with this arrangement, improved, more compact storage is attained for the tables 100. As shown in FIG. 18, the table and seating arrangements 100 may be stored in an edge-to-edge relationship with the ends and sides of the tabletops 102 abutting one another. Moreover, the tables may be pushed up against walls and into corners of rooms flush against the walls for improved storage with no wasted space. As is especially important when children are present, this arrangement eliminates access to open areas between tables and minimizes the possibility of fingers being pinched or other problems associated with storage of such table and seating arrangements.

It can also be appreciated that the seating assemblies 120 pivot easily with little effort required so that they may be easily and simply operated with only one hand or by children. There are no latches or other mechanisms to release or actuate prior to moving between the use position and the storage position.

To move from the use position shown in FIGS. 1-4 to the storage position shown in FIG. 5, the seating assemblies 120 are pivoted inward. The seating assemblies pivot through intermediate positions shown in FIGS. 6 and 7 wherein the seats 122 and the legs 126 pass the support portion 110 and the underside of the tabletop 102. It can be appreciated that the present invention provides for a standard height table with improved stability. Moreover, the stool height and leg height provide for folding and use of the table without impacting comfort of the user or diminishing access. As explained hereinafter, it can also be appreciated that the stools may be interchanged with benches without modifying the frame 104.

Figure 8:
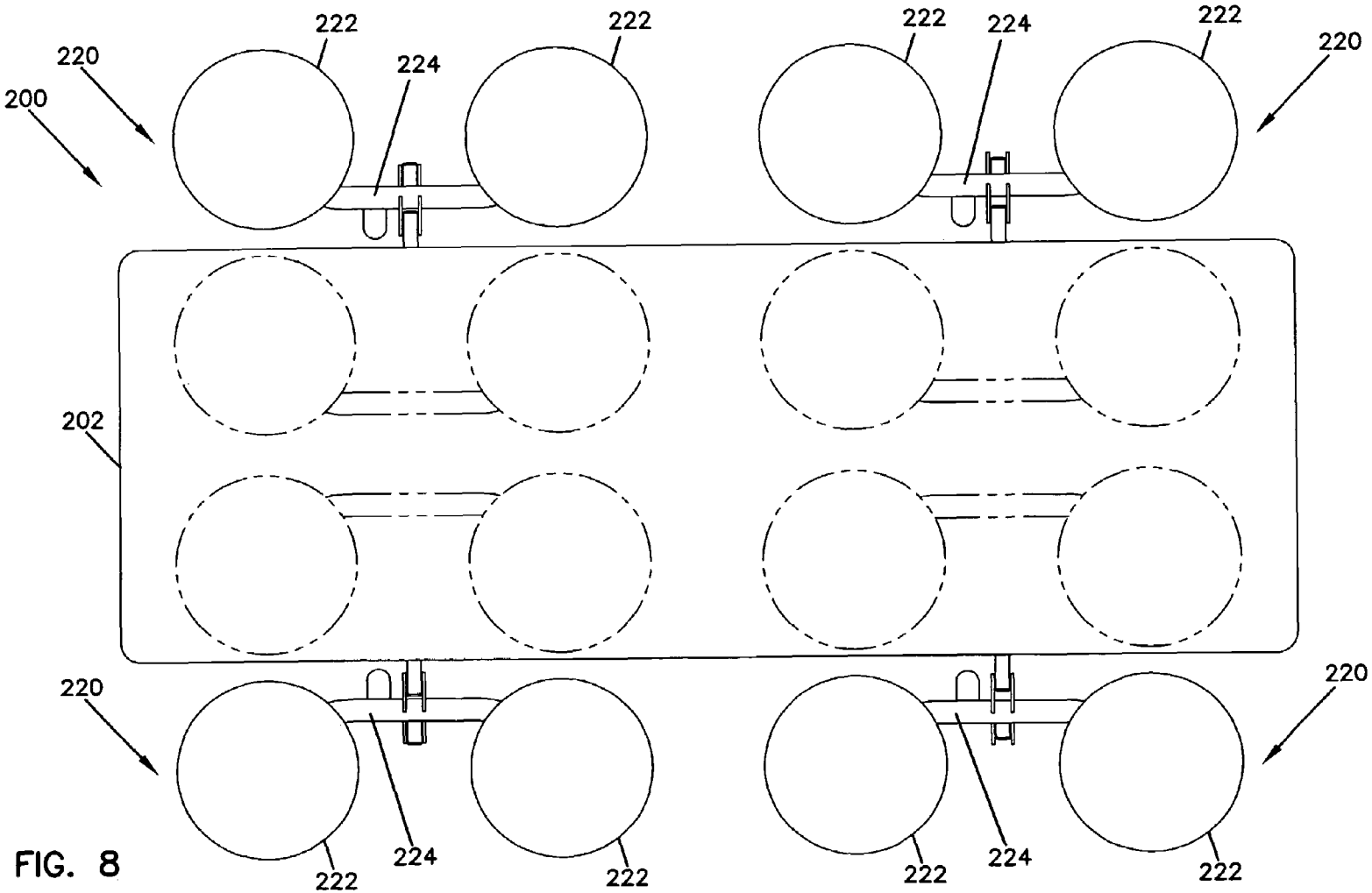
FIG. 8 is a top plan view of a second embodiment of a table and seating arrangement in the use position according to the principles of the present invention.

Referring now to FIG. 8, there is shown a second embodiment of a table and seating arrangement, generally designated 200. The table and seating arrangement 200 is similar to the table and seating arrangement 100, but has a different folding linkage, as explained below. The table and seating arrangement 200 includes a stationary tabletop 202 supported by a rigid frame 204. The frame 204 includes several frame sections as discussed below and mounts on four casters or wheels 212 so that the table 200 may be rolled from location to location for use and storage. The frame 204 also supports four seating assemblies 220 mounted on linkages that shift between a use and storage position as explained hereinafter. Although four seating assemblies 220 are shown, it can be appreciated that other versions are possible with other types and/or numbers of seating assemblies 220, as explained hereinafter. In addition, one or more of the seating assemblies 220 may be omitted, thereby providing ADA seating.

Figure 9:
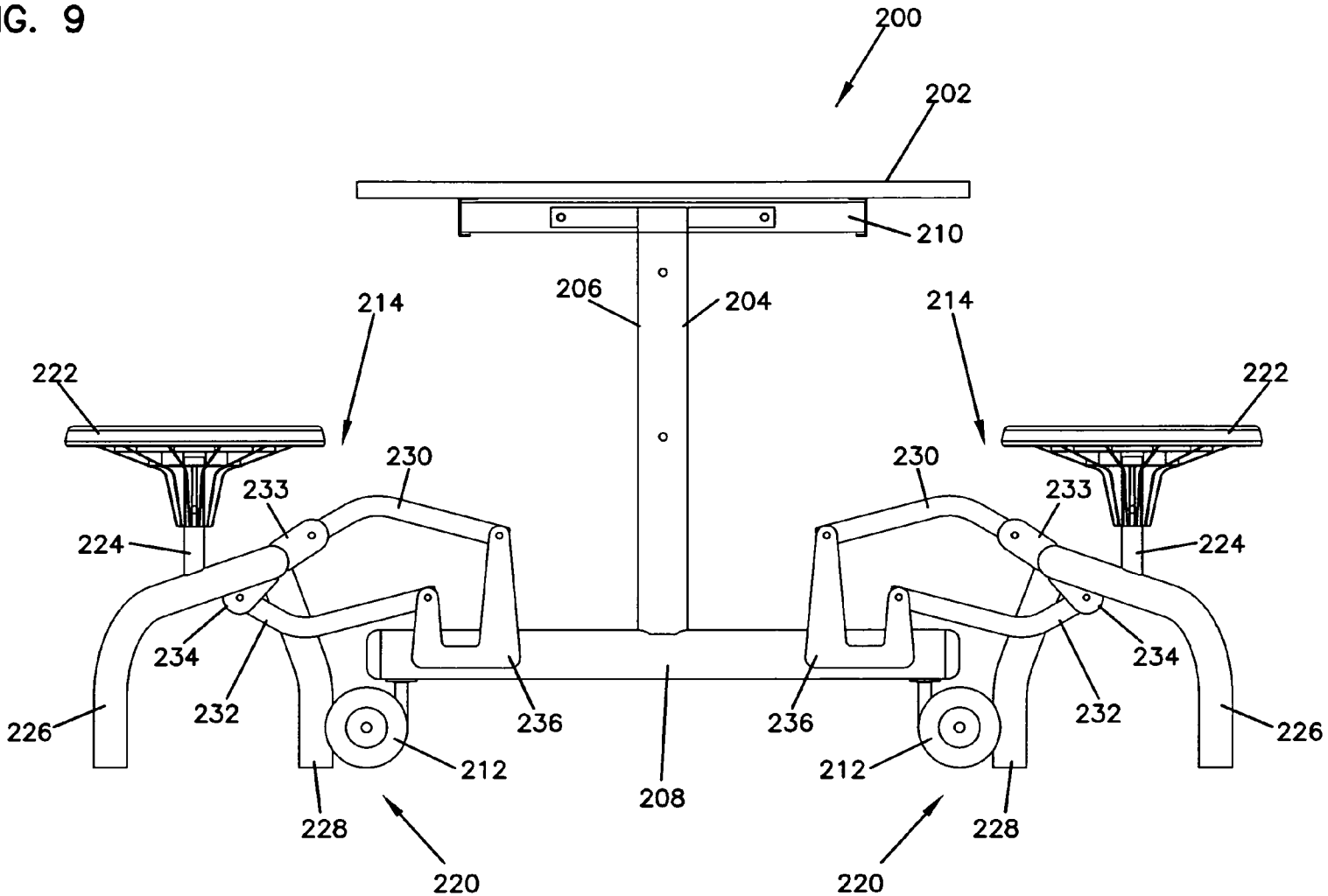
FIG. 9 is an end elevational view of the table and seating arrangement shown in FIG. 8.
Figure 10:
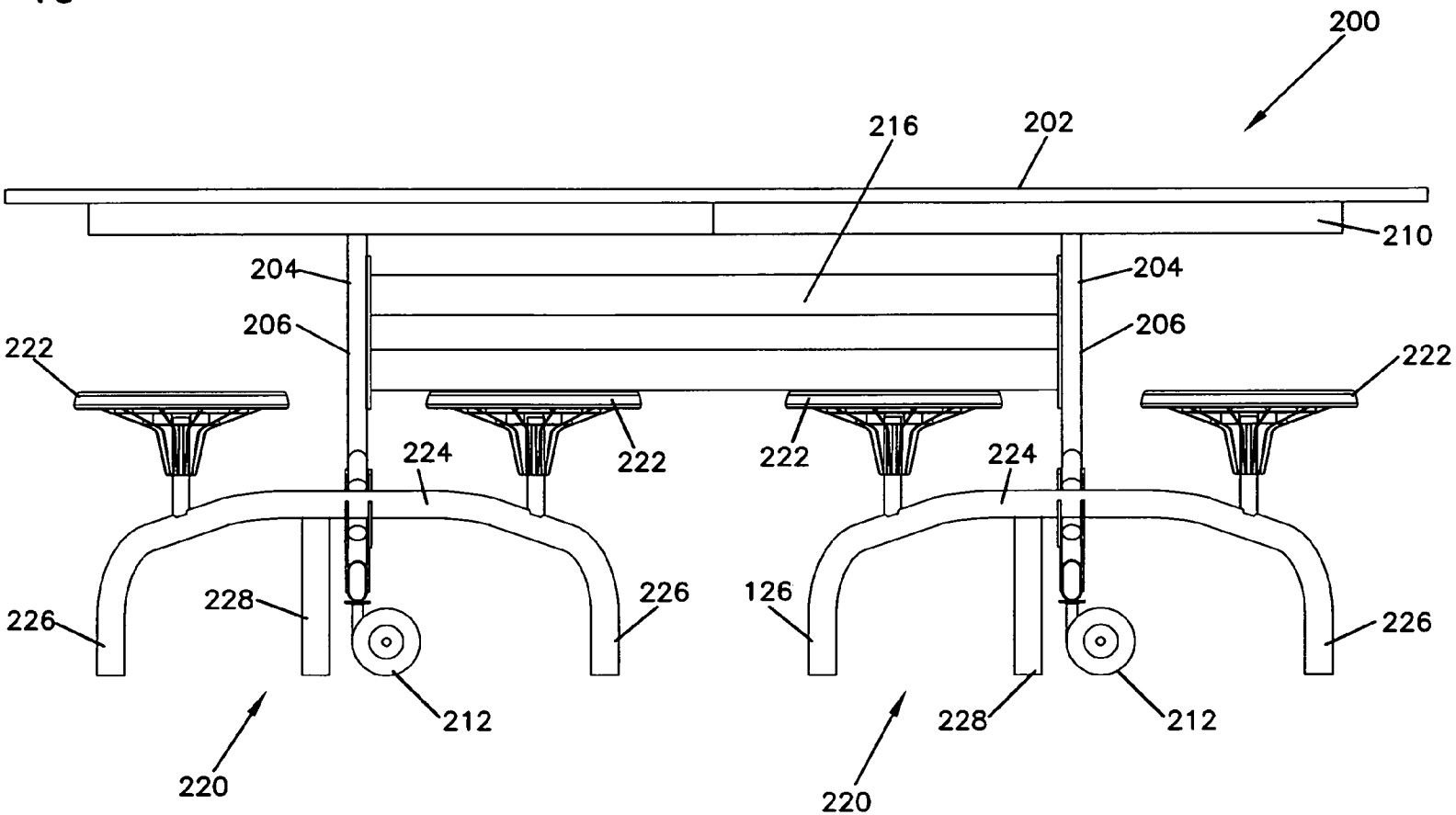
FIG. 10 is a side elevational view of the table and seating arrangement shown in FIG. 8.
Figure 11:
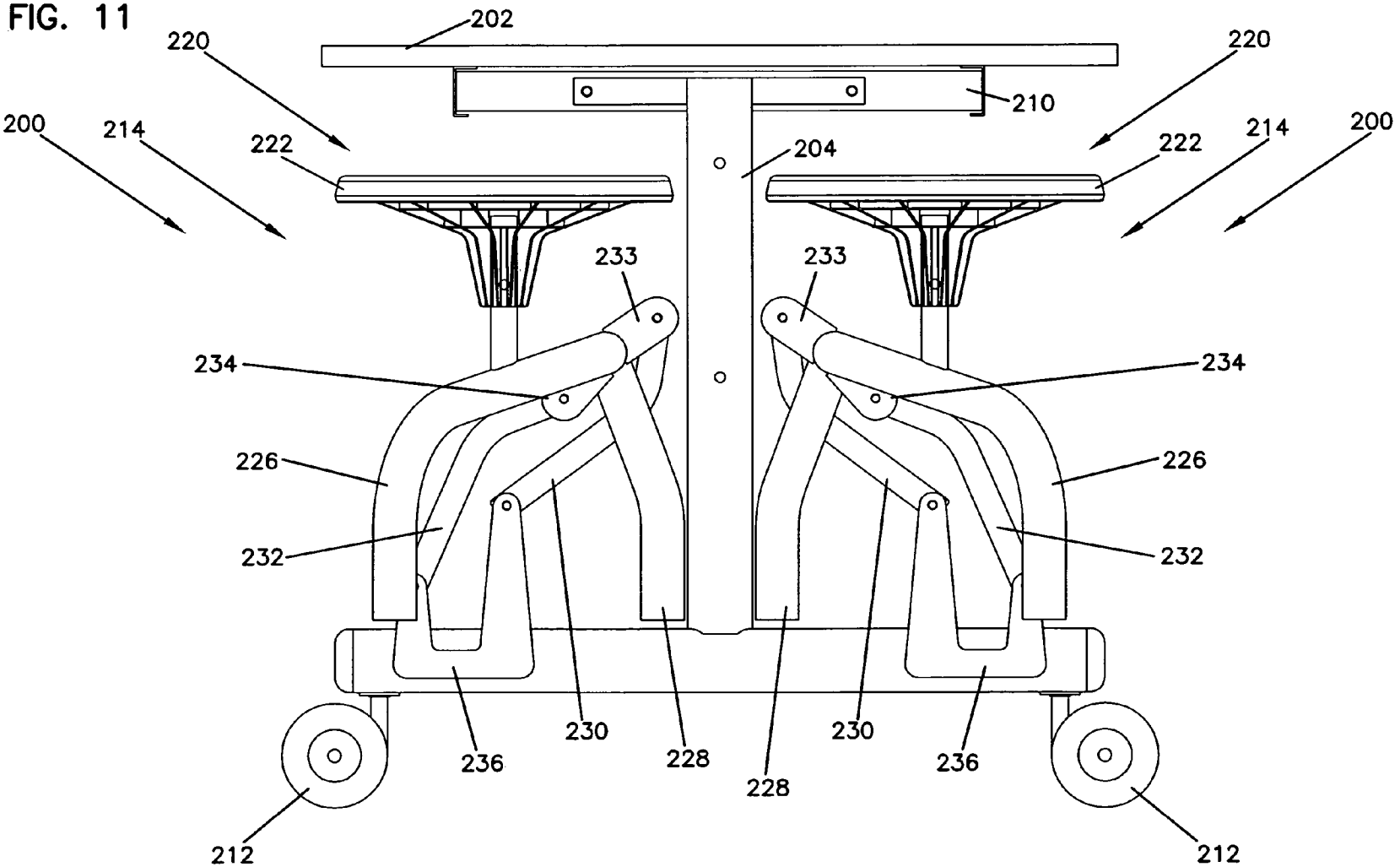
FIG. 11 is an end elevational view of the table and seating arrangement shown in FIG. 8 with the seats in the storage position.

Referring now to FIGS. 9-11, the table and seating arrangement frame 204 has two riser portions 206 connected by a longitudinal member 216 and extending upward from horizontal transverse members 208 extending laterally. A tabletop support portion 210 mounts to the underside of the tabletop 202 and is supported by the upper ends of the riser portions 206. The casters or wheels 212 mount at the ends of the transverse members 208 and preferably swivel so that transporting the table 200 is easily accomplished in any direction. Each of the seating assemblies 220 translationally mounts to the frame members 208 on linkages 214 and includes stools 222, or a bench, mounted on a seating assembly frame 224. Each seating assembly 220 includes two stools 222 supported by the frame 224 and mounted so that each stool 222 may be accessed through an open passage without requiring a user to step over an obstruction, such as a frame. The seating assembly frame 224 includes a pair of legs 226 and in some embodiments includes a third leg 228 that engage the ground in the use position and provide a stable base for each seating assembly 220. Each linkage 214 includes links 230, 232, 233 and 234 as well as mounts 236 providing for movement between the use position shown in FIGS. 9 and 10 and the storage position shown in FIG. 11. The linkages 214 are configured to prevent the seating arrangements 220 from folding too far inwardly. The seating assemblies 220 move past an over center location so that the assemblies 200 stay at the retracted storage position without requiring a restraint or lock as shown in FIG. 11.

As shown in FIG. 11 and as shown in phantom in FIG. 8, when the seating assemblies 220 are moved to the storage position, the stools 222 are completely beneath the tabletop 202 and do not extend beyond the tabletop edges. It can be appreciated that this arrangement provides for improved, more compact storage.

It can also be appreciated that the seating assemblies 220 are very lightweight and may be operated simply and easily with only one hand or even by children. There are no latches or other mechanisms to release or actuate prior to moving between the use position or storage position. To move from the use position shown in FIG. 9 to the storage position shown in FIG. 11, the seating assemblies 220 are simply lifted upward and inward. To move from the storage position shown in FIG. 11 to the use position shown in FIG. 9, the seating assemblies 220 are simply grasped and pulled outward and downward. The stools 222 are sturdily supported as the legs 226 and 228 engage the ground in the use position and provide a stable base for the seating assembly 220.

It can further be appreciated that the continuous tabletops 102 and 202 do not fold and remain horizontal at all times so that computers, keyboards and other similar equipment may be left on the tabletop 102 or 202 when not in use and simply rolled with the table and seating arrangement for storage. This eliminates the need for further storage space for this equipment and speeds setup and take down. The use of a table and seating arrangement 100 and 200 without a folding table top eliminates folding linkages for the table. Moreover, torsion bars, which are often employed with such arrangements, are not needed, thereby lowering complexity, costs and weight.

The tabletop 102 or 202 may be configured with various widths and lengths, but preferably fits through a standard 32 inch door. Moreover, in the storage position for a 30 inch by 84 inch table with 8 stools, a common configuration, the area for storage surprisingly requires only 2.19 square feet per seat. This is favorable as compared to arrangements with folding tables, but have seating extended while stored, which often have storage needs of 3 square feet per seat or higher.

Figure 12:
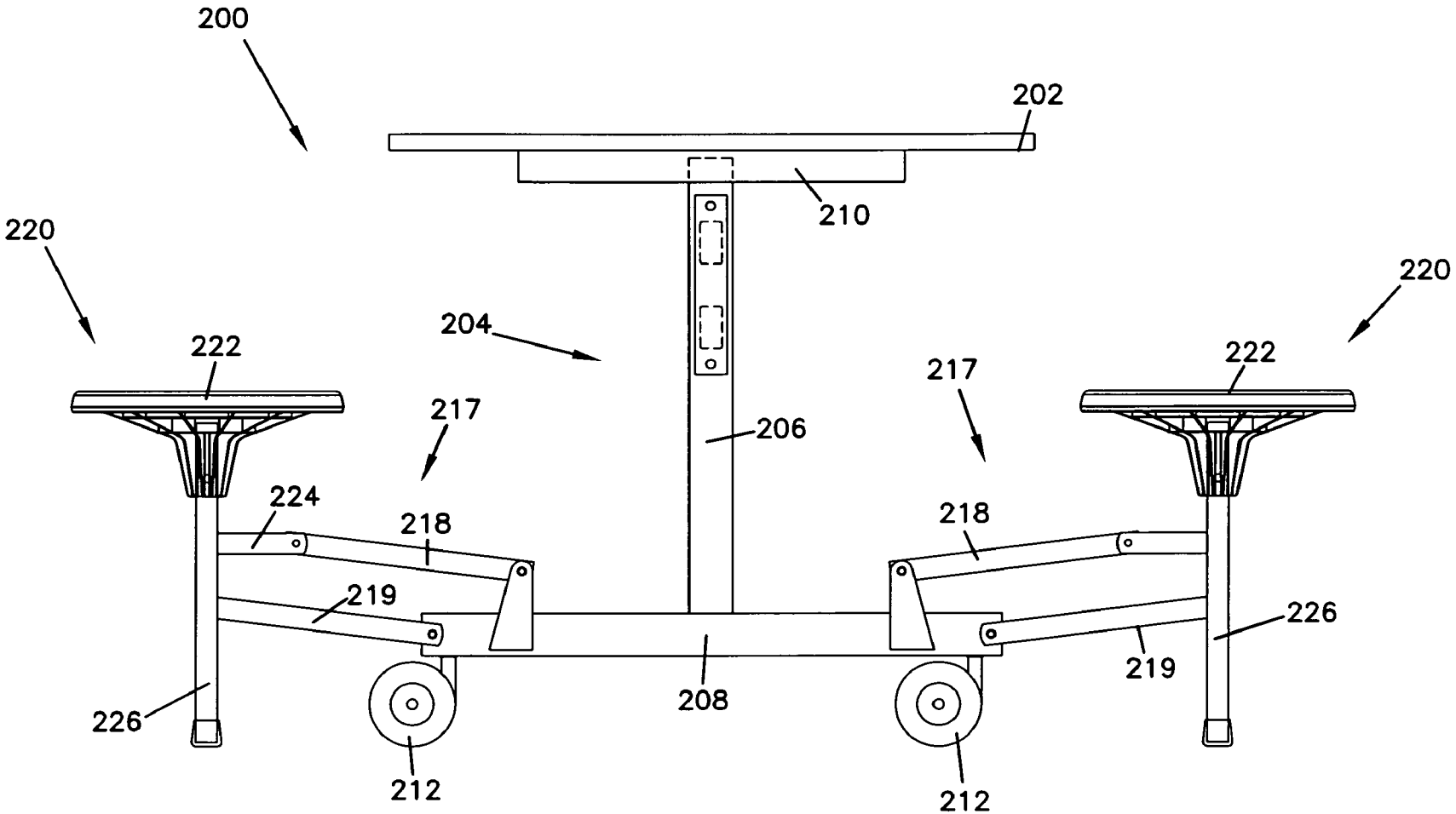
FIG. 12 is an end elevational view of a third embodiment of a table and seating arrangement according to the principles of the present invention.
Figure 13:
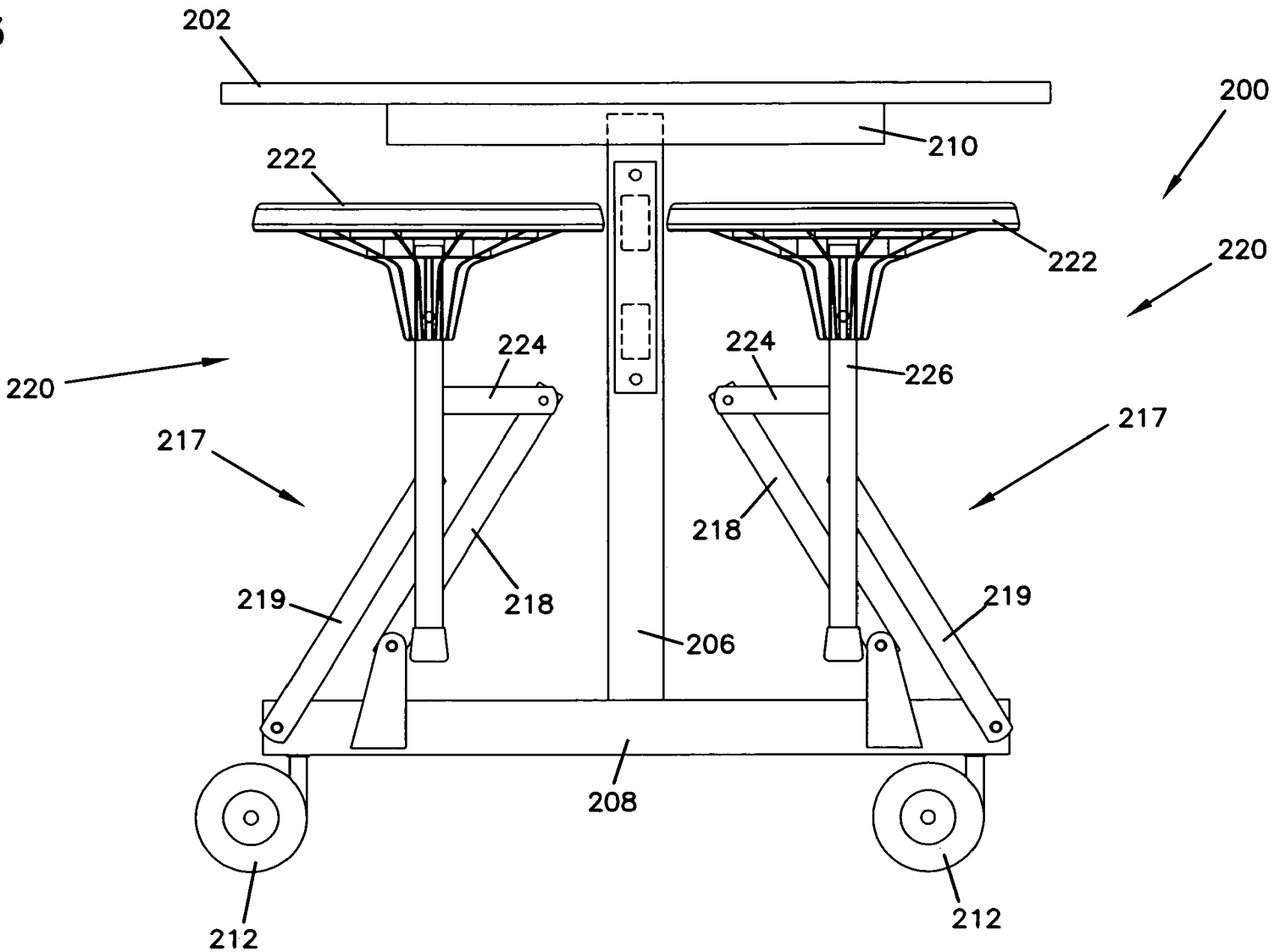
FIG. 13 is an end elevational view of the table and seating arrangement shown in FIG. 12 with the seats in the storage position.

Referring now to FIGS. 12 and 13, there is shown a third embodiment of the table and seating arrangement, also designated 200. The arrangement is substantially the same as the embodiment shown in FIGS. 8-11 with a slight variation of the seating assemblies 220. As shown in FIGS. 12 and 13, with sufficient load capacity built into linkages 217, two links 218 and 119 are sufficient. Moreover, a sturdy base is created with only two legs 226 used per seating assembly 220. The seating assemblies 220 are supported on a solid base formed by the legs 226 and the frame 204.

Figure 14:
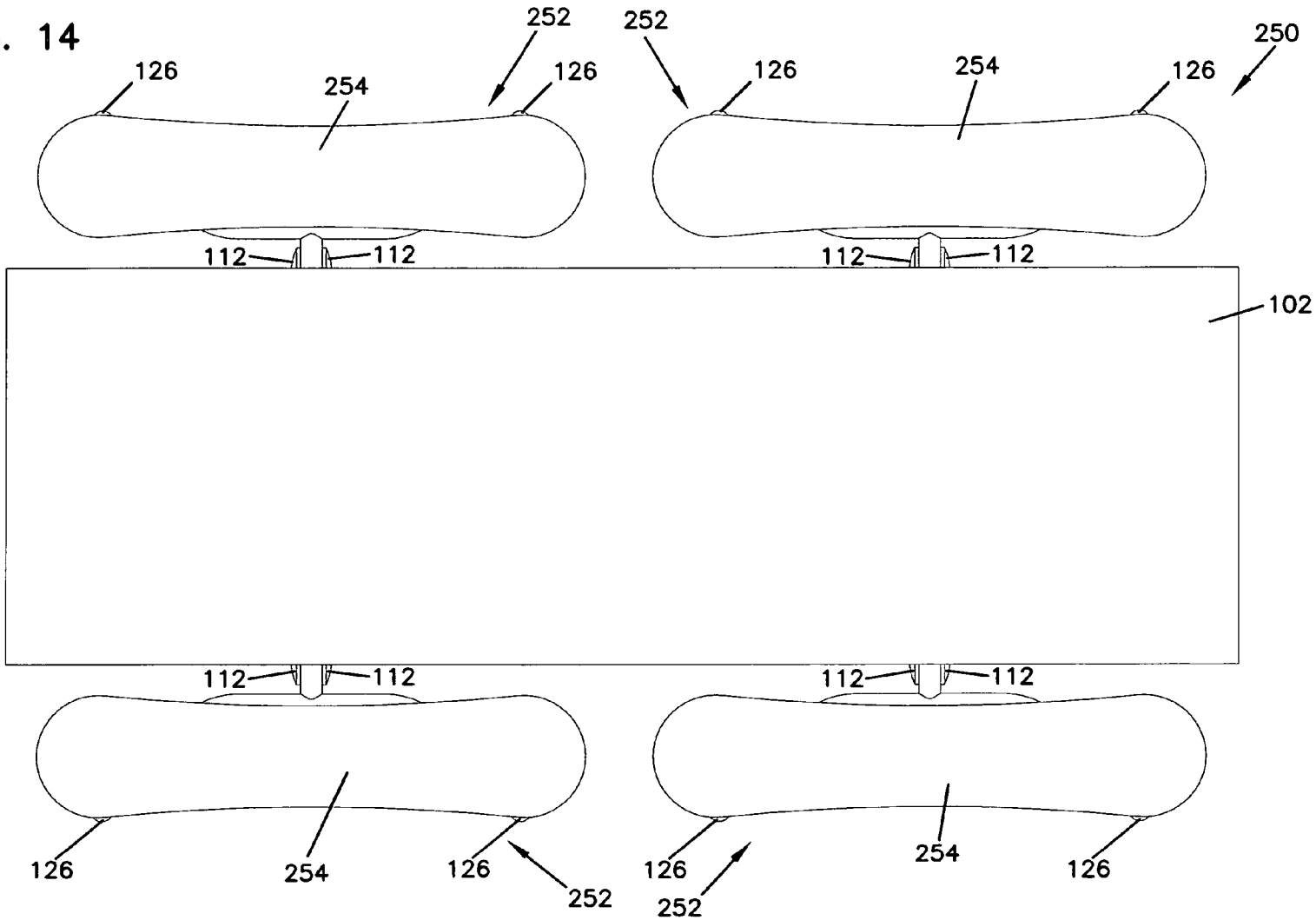
FIG. 14 is a top plan view of a fourth embodiment of a table and seating arrangement according to the principles of the present invention.
Figure 15:
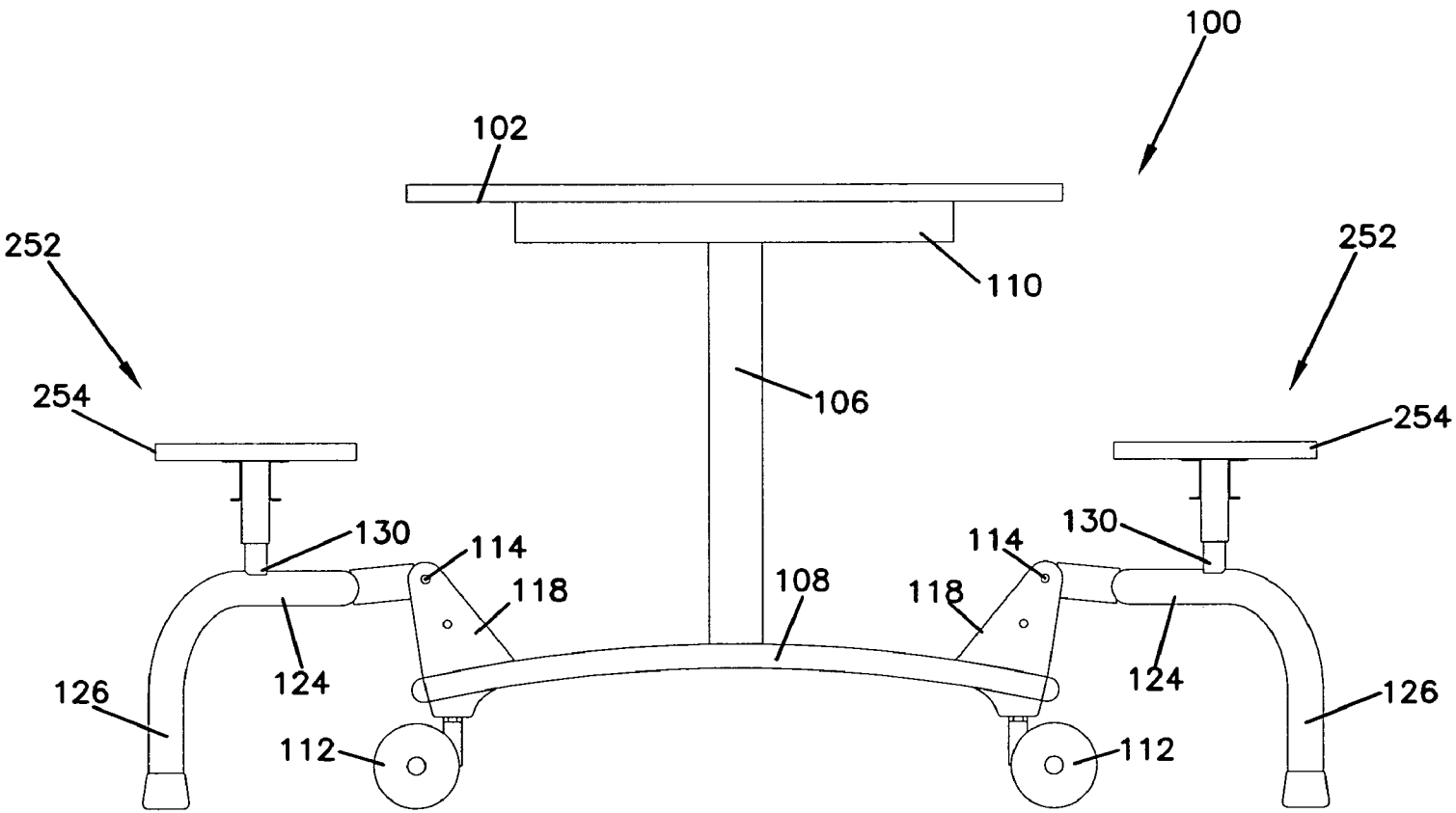
FIG. 15 is an end elevational view of the table and seating arrangement shown in FIG. 14.

Referring now to FIGS. 14 and 15, it can be appreciated that other seating arrangements may be utilized in addition to stools. In another embodiment, a table and seating arrangement 250 includes bench-type seating assemblies 252 having benches 254. The benches 254 mount and translate in the same manner as the stools shown in FIGS. 1-7. In the embodiment shown in FIG. 14 the table and seating arrangement 250 has two seating assemblies 252 per side with a space between the inner ends of the benches 254. With this configuration, bench seating is achieved, providing increased seating capacity at the same size table. It can be appreciated that the present invention is configured so that two stools for each seating assembly are easily interchangeably mounted with a bench without modifying the frame. This provides improved flexibility and utility. Moreover, the legs 126 are still positioned at an outer edge of the benches 254 to provide solid support without interfering with accessibility for users or causing a tripping hazard.

Figure 16:
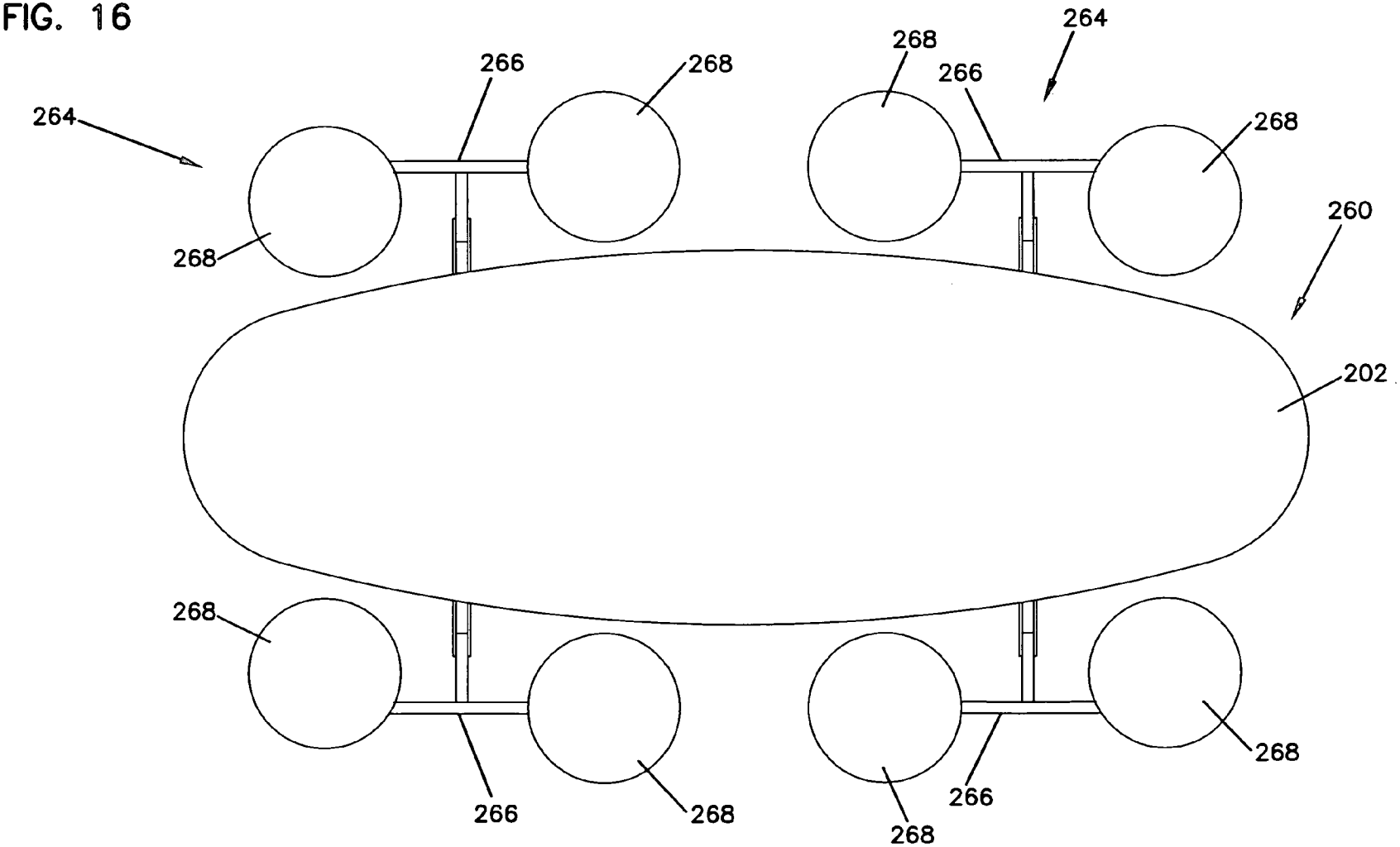
FIG. 16 is a top plan view of a fifth embodiment of a table and seating arrangement according to the principles of the present invention.

Referring now to FIG. 16, there is shown a further embodiment according to the principles of the present invention of a table and seating arrangement, generally designated 260. The table and seating arrangement 260 is similar to the seating and table arrangement 200 except that for the shape of the tabletop. The table and seating arrangement 260 includes an oval tabletop 262 as may be preferred for some uses. In addition, the oval table and seating arrangement 260 includes seating assemblies 264 that have a frame 266 that positions all stools 268 at a proper distance relative to the edge of the tabletop. The seating assemblies 264 move and function in substantially the same manner as described for the other embodiments.

Figure 17:
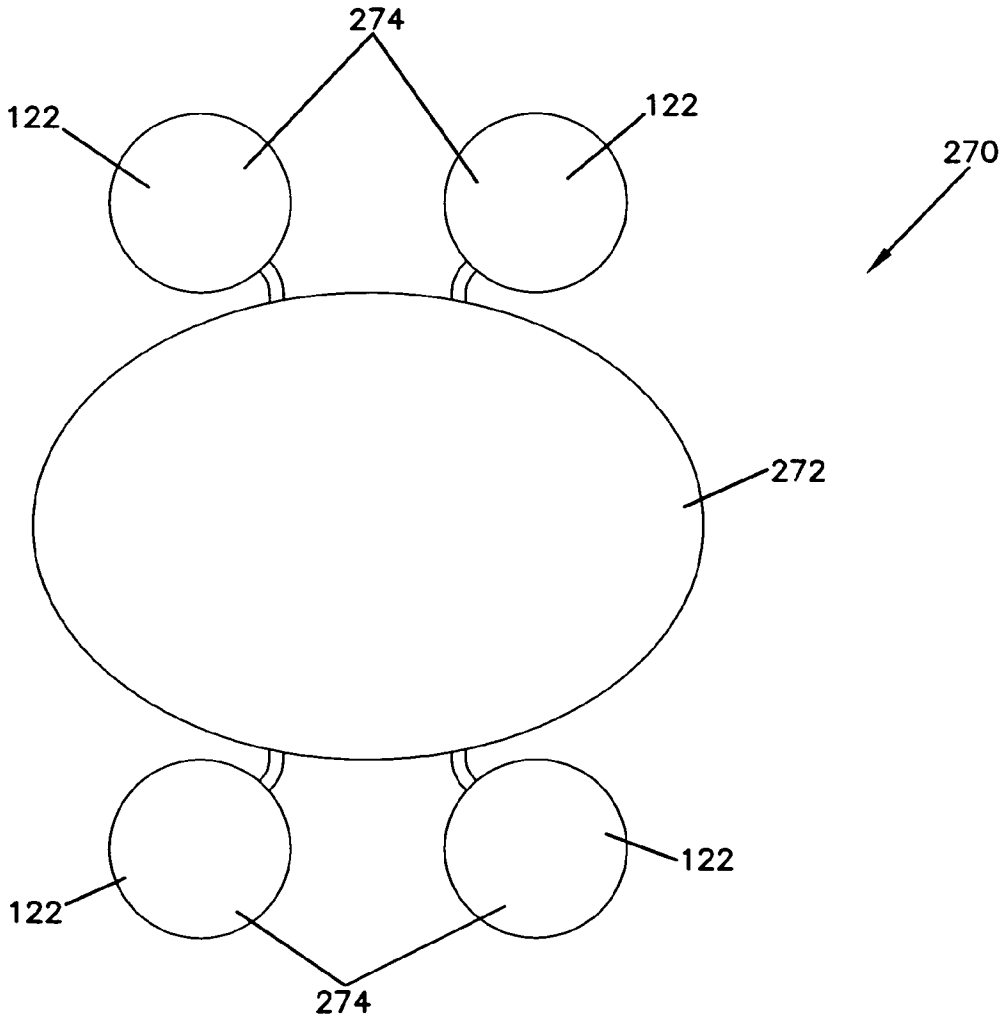
FIG. 17 is a top plan view of a sixth embodiment of a table and seating arrangement according to the principles of the present invention.

Referring now to FIG. 17 there is shown yet another embodiment of a table and seating arrangement according to the present invention, generally designated 270. The table and seating arrangement 270 has a shorter oval tabletop 272 than the oval tabletop shown in FIG. 16. Seating assemblies 274 are the same as seating assemblies 220, but there is only one seating assembly per side rather than two.

Further embodiments are possible with different tabletop shapes and with different numbers of seats and various combinations of seating. Moreover, it can be appreciated that with the storage of stools beneath the tabletop, the present invention provides for shipping with the stools attached. Folding tables generally require unfolding of the table and then mounting of the seats, rather than being ready for use when shipped. The present invention provides a safe, reliable and efficiently stored system that is neither known nor obvious from the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A table and seating arrangement, comprising:

a tabletop defining a longitudinal direction and having an underside and an edge;

a table frame supporting the tabletop;

at least one seat assembly having at least one seat and mounted to the table frame on a pivot about a horizontal axis, wherein the seat assembly is pivotable about the horizontal axis between a use position wherein the seat assembly engages the ground and the at least one seat extends beyond the edge of the tabletop, and a storage position wherein the seat assembly disengages the ground and is positioned below the underside of the tabletop;

wherein the at least one seat assembly includes a seat support frame having a seat support portion beneath and fixed to the at least one seat, and a plurality of ground engaging portions configured to engage the ground in the use position, wherein the ground engaging portions are spaced longitudinally apart from the seat support portion and wherein the ground engaging portions are spaced outward further from the edge of the tabletop than the seat support portion.

2. A table and seating arrangement according to claim 1, wherein the at least one seat assembly includes two ground engaging portions spaced longitudinally from the seat support portion, and wherein the seat support portion is longitudinally intermediate the ground engaging portions.

3. A table and seating arrangement according to claim 1, wherein the seat is entirely under the tabletop in the storage position.

4. A table and seating arrangement according to claim 1, comprising a plurality of seats.

5. A table and seating arrangement according to claim 1, wherein the seats are mounted in pairs on an associated single pivot.

6. A table and seating arrangement according to claim 5, wherein the single pivot of the seating assembly is centered intermediate the pair of seats.

7. A table and seating arrangement according to claim 6, wherein the seating assembly is configured so that each seat is accessible without a user passing over a framework or support portions.

8. A table and seating arrangement according to claim 1, wherein the at least one seat comprises a stool.

9. A table and seating arrangement according to claim 8, wherein the at least one stool is proximate the underside of the tabletop in the storage position.

10. A table and seating arrangement according to claim 9, wherein the stools are mounted in pairs on a single horizontal pivot.

11. A table and seating arrangement according to claim 1, wherein the at least one seat comprises a bench.

12. A table and seating arrangement according to claim 11, wherein the bench is proximate the underside of the tabletop in the storage position.

13. A table and seating arrangement according to claim 1, wherein the table comprises a rectangular table.

14. A table and seating arrangement according to claim 1, wherein the table comprises an oval table.

15. A table and seating arrangement according to claim 1, further comprising rolling devices mounted to the frame and providing for movement of the table in the storage position.

16. A table and seating arrangement according to claim 1, wherein the at least one seat comprises a seating surface, wherein the seating surface is horizontal and faces upward in the use position and faces downward in the storage position.

17. A table and seating arrangement according to claim 1, wherein each ground engaging portion extends downward substantially aligned with an edge of an associated seat.

18. A table and seating arrangement according to claim 1, wherein each of the seat assemblies pivots such that an inner edge of the seat clears the frame of the tabletop and an outer edge of the seat clears the edge of the tabletop during folding and unfolding.

19. A table and seating arrangement according to claim 1, wherein the seats comprise interchangeably mounted stools and benches.

20. A table and seating arrangement according to claim 1, wherein the seating assembly is pivotable about the horizontal axis: between a first use position wherein the ground engaging portions engage the ground, a second intermediate position wherein an inner edge of the seat passes through a point at a height even with the tabletop frame and beneath the tabletop, a third intermediate position wherein an outer edge of the seat passes below the tabletop frame; and a fourth storage position wherein the seat is retracted and fully beneath the tabletop.

21. A table and seating arrangement according to claim 1, wherein each seating assembly comprises seating for a plurality of users supported on a single pivot on the table frame at an inner side of the seating assembly.

22. A table and seating arrangement according to claim 1, wherein the table frame includes a cross member and a portion extending upward to each pivot.

23. A table and seating arrangement, comprising:

a tabletop defining a longitudinal direction and having an edge and an underside;

a frame mounted to the underside of the table top, the frame including first and second riser portions and a substantially horizontal portion extending from a lower end of each riser portion;

rolling devices mounted to each horizontal portion of the frame and supporting the table and seating arrangement;

four spaced apart pivot assemblies having a horizontal axis, each of the pivot assemblies mounted to and above an end of the horizontal portions of the frame;

a seating assembly mounted to each of the pivot assemblies and moving between an extended position and a retracted position, each of the seating assemblies including two seats and at least two legs, wherein the legs extend laterally outward from the seats and further from a longitudinal centerline of the tabletop than the seats;

wherein the seating assemblies move on the pivot about the horizontal axis between a use position with the legs engaging the ground and a storage position with the seats retracted underneath the underside of the tabletop.

24. A table and seating arrangement according to claim 23, wherein the seats are completely beneath the underside of the tabletop in the storage position and positioned inward from the edge.

25. A table and seating arrangement according to claim 23, wherein the seats comprise stools.

26. A table and seating arrangement according to claim 25, wherein the stools are positioned proximate the underside of the tabletop in the storage position.

27. A table and seating arrangement according to claim 23, wherein each pair of seats includes three spaced apart legs configured to engage the ground when the seating assemblies are in the use position.

28. A table and seating arrangement according to claim 23, wherein the table comprises a rectangular table.

29. A table and seating arrangement according to claim 23, wherein the table comprises an oval table.

30. A table and seating arrangement according to claim 23, wherein the seats comprise interchangeably mounted stools and benches.

31. A table and seating arrangement according to claim 23, wherein each of the seats comprises a seating surface, wherein the seating surface is horizontal and faces upward in the use position and faces downward in the storage position.

* * * * *